US005740614A

United States Patent [19]

Carder et al.

[11] Patent Number: 5,740,614

[45] Date of Patent: Apr. 21, 1998

[54] TOOL FOR CUTTING ELONGATE STRIPS FROM CARPET

[76] Inventors: William E. Carder, 4 Spyglass Hill, Fairport, N.Y. 14450; Timothy Carder, 310 Cromwell Dr., Roch, N.Y. 14610

[21] Appl. No.: 738,089

[22] Filed: Oct. 25, 1996

[51] Int. Cl.[6] ..... B26B 5/00; B26B 29/06

[52] U.S. Cl. ..... 30/293; 30/287; 30/304

[58] Field of Search ..... 30/289, 293, 294, 30/286, 287, 304, 305; 83/614, 446

[56] References Cited

U.S. PATENT DOCUMENTS

| | | | |
|---|---|---|---|
| 2,409,203 | 10/1946 | Gale | 83/614 |
| 3,621,573 | 11/1971 | Summers | 30/287 |
| 3,724,071 | 4/1973 | Hurtubise | 30/287 |
| 4,148,142 | 4/1979 | Sullivan et al. | 30/293 |
| 5,581,894 | 12/1996 | Scharf | 30/293 |

*Primary Examiner*—Hwei-Siu Payer
*Attorney, Agent, or Firm*—Shlesinger Fitzsimmons Shlesinger

[57] ABSTRACT

A plurality of blade supporting blocks are secured on the face of a base plate, which has a flange along one side thereof adjustably secured by bolts to one leg of a right angular support plate, the other leg of which extends beneath and in spaced parallel relation to the base plate. Adjustably mounted in each of one or more recesses in each block is a cutting blade, the lower cutting end of which extends through one of a plurality of spaced slots in the base plate. In use, the support plate supports the base plate above the carpet that is to be cut, and with a plurality of cutting blades extending beneath the base plate.

13 Claims, 2 Drawing Sheets

TOOL FOR CUTTING ELONGATE STRIPS FROM CARPET

BACKGROUND OF THE INVENTION

This invention relates to carpet cutting tools, and more particularly to a novel tool for simultaneously cutting a plurality of elongate strips of carpet from a piece thereof.

There are currently available a variety of carpet cutting tools that have been designed, primarily, for trimming the edges of a carpet upon installation thereof in a home or office. Typically such cutters are designed to cot a predetermined edge on a carpet, for example when two edges of two separate sections of carpet are to be secured so that the resulting seam is almost unobservable. U.S. Pat. No. 5,353,508, for example discloses a base or support plate having adjustably mounted thereon a cutter having a blade which is adjustable diagonally through a slot in the support plate. A pair of spaced guides on the support plate are engageable with a straight edge to guide the cutting knife in a predetermined direction relative to the carpet during a cutting operation. In use the support plate is positioned on the carpet and then shifted in the direction of the desired cut. One of the disadvantages of such mechanism is that it can only make one cut at a time, and there is no provision for adjusting the plate vertically relative to the carpet to accommodate the cutter for use with carpets of different pile heights.

Numerous other prior art cutters are disclosed in U.S. Pat. No. 5,209,148; U.S. Pat. No. 2,004,517; U.S. Pat. No. 3,934,341, U.S. Pat. No. 2,238,678; U.S. Pat. No. 4,578,865; U.S. Pat. No. 5,036,590 and U.S. Pat. No. 5,159,758, but none of these additional prior art patents has the ability of cutting a plurality of carpet strips at the same time. Moreover, none of such prior art devices are particularly adapted for cutting strips from pile carpets, the pile heights of which may differ from carpet to carpet.

It is an object of this invention, therefore, to provide a novel cutting tool or device for accurately and easily cutting a plurality of elongate strips of carpet simultaneously from a piece of carpet.

Another object of this invention is to provide a device of the type described which includes a plurality of cutter blades that are individually adjustable to adapt the tool for use in connection with pile carpets which have pile heights of different heights.

Still another object of this invention is to provide a novel cutter of the type described which includes means for supporting the cutter for vertical adjustment relative to the surface of a carpet which is to be cut.

Other object of the invention will be apparent hereinafter from the specification and from the recital of the appended claims, particularly when read in conjunction with the accompanying drawings.

SUMMARY OF THE INVENTION

A rectangular base plate has secured to the face thereof three, spaced, cutter supporting blocks generally similar in configuration, but one of which is approximately twice as wide as the other two. Each of the two narrower blocks has a cutting blade adjustably mounted in a recess formed in one side of the associated block to extend diagonally downwardly toward, and to open at its lower end upon, one of two, parallel slots formed in the base plate. Two additional cutting blades are adjustably mounted in similar, diagonally extending recesses formed in opposite sides of the third, wider block to register at their lower ends, respectively, with two additional parallel slots formed in the base plate in spaced, parallel relation with the slots associated with the two narrower blocks. Each of the foregoing blades can be adjusted in its associated recess to have its lower, cutting end extend to an operative position beneath the base plate, or can be retracted to an inoperative position above the lower surface of the plate.

An arcuate handle is secured on the base plate to overlie the wider block; and an elongate, narrow guide strip is secured to the underside of the base plate centrally thereof, and has opposed side edges extending parallel to the slots in the base plates. Either edge of the guide strip may be engaged with a separate, conventional straight edge to guide the cutter during use. An upturned flange formed along one side of the base plate is secured for vertical adjustment on the upstanding or vertical leg of a right angular bracket, the other leg of which is disposed to rest on a floor, or the like, to support the base plate for vertical adjustment relative to the section of carpet that is to be cut into strips by the cutting blades.

THE DRAWINGS

DETAILED DESCRIPTION OF THE PREFERRED EMBODIMENTS

Figure 1:
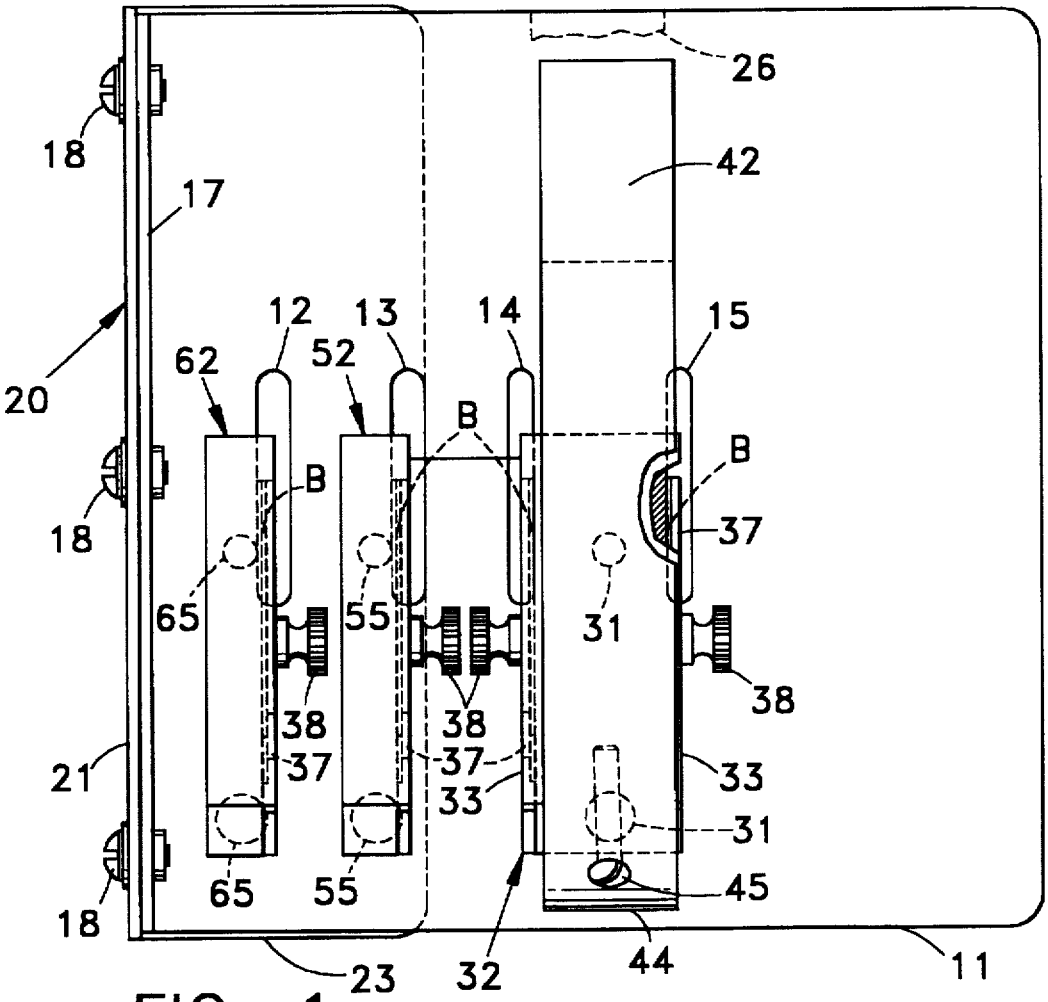
FIG. 1 is a top plan view of a carpet cutting device or tool made according to one embodiment of this invention.
Figure 2:
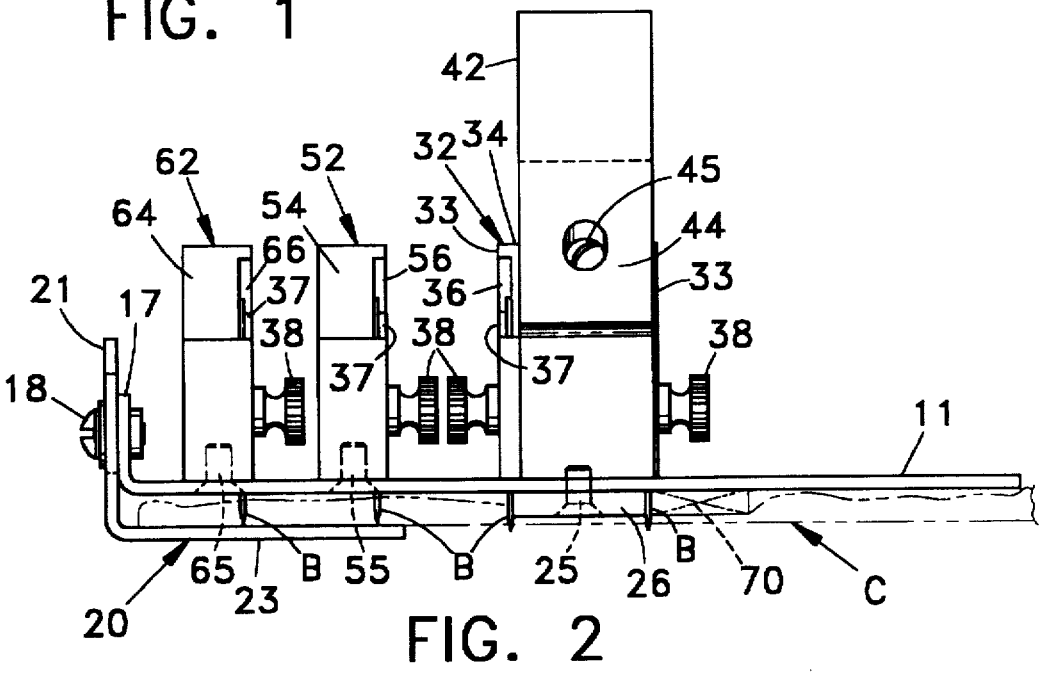
FIG. 2 is a front elevational view of this device as seen when mounted in a cutting position on a carpet, which is shown in phantom by broken lines in this FIG.
Figure 3:
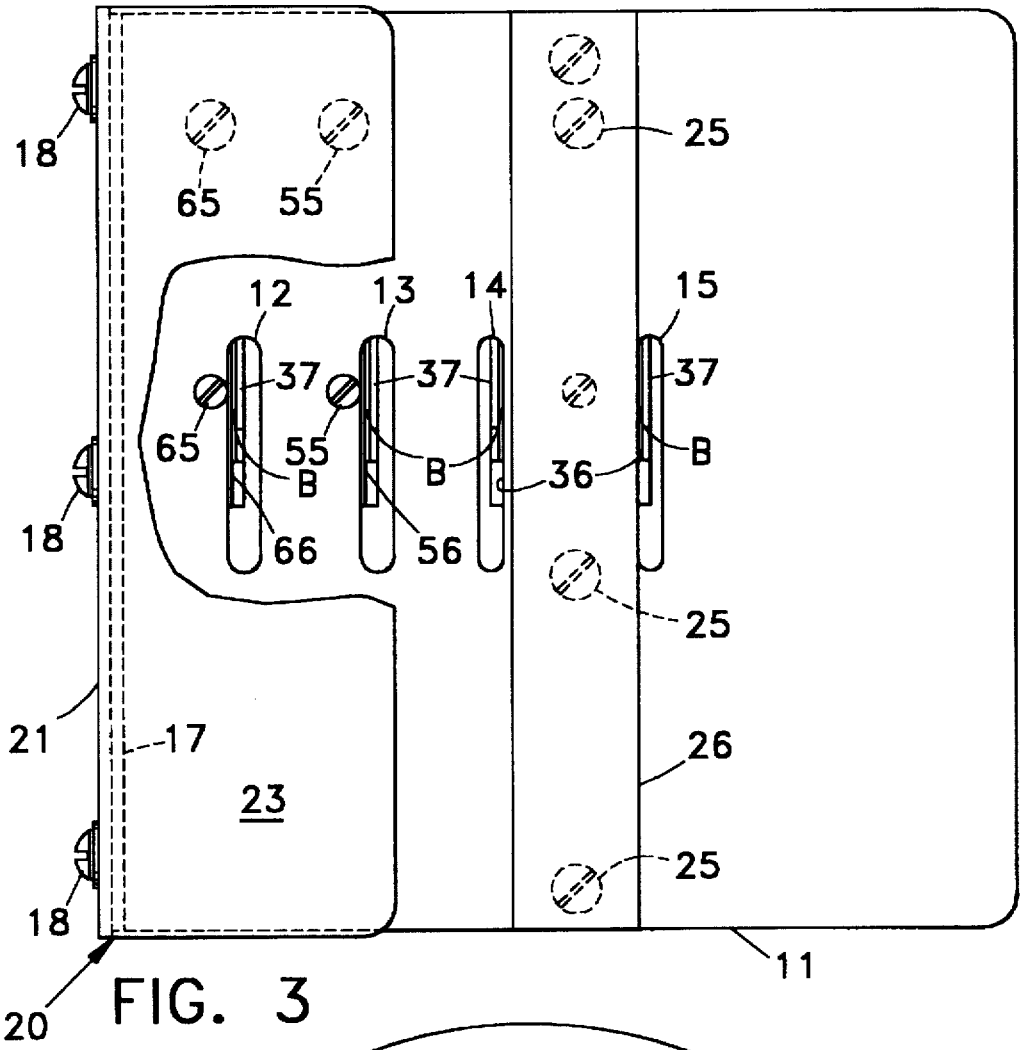
FIG. 3 is a bottom plan view of this device with a portion thereof cut away for purposes of illustration.

Referring now to the drawings by numerals of reference, 11 denotes a metal base plate which is generally rectangular in configuration, and which has therethrough four, spaced, parallel slots 12, 13, 14 and 15 that extend transversely of the forward and rear edges, respectively, of plate 11. Adjacent one side edge thereof, the left edge as shown in FIGS. 1 to 3, a marginal portion of plate 11 is bent upwardly to form on the plate an upstanding flange 17, which is adjustably secured by a plurality (three in the embodiment illustrated) of conventional nut and bolt combinations 18 to a right angular support bracket denoted generally by the numeral 20. Bracket 20 has a vertically disposed leg section 21 having therein three, spaced, parallel, vertically extending slots 22 (FIG. 4) through each of which passes the shank of one of the bolts of the nut/bolt combinations 18. The other leg section 23 of the bracket 20 passes beneath and is disposed in spaced, parallel relation with, the underside of plate 11 adjacent one side thereof (the left side as shown in FIGS. 1 to 3). Obviously, by adjusting the nut/bolt combinations 18 the plate 11 can be adjusted vertically relative to the leg section 23 of the bracket 20. As noted hereinafter, leg section 23 is disposed to be supported on a plane, flat surface, such as a floor, and in so doing then supports plate 11 slightly above and parallel to the floor, and over the top of a section of carpet that is to be cut.

Figure 4:
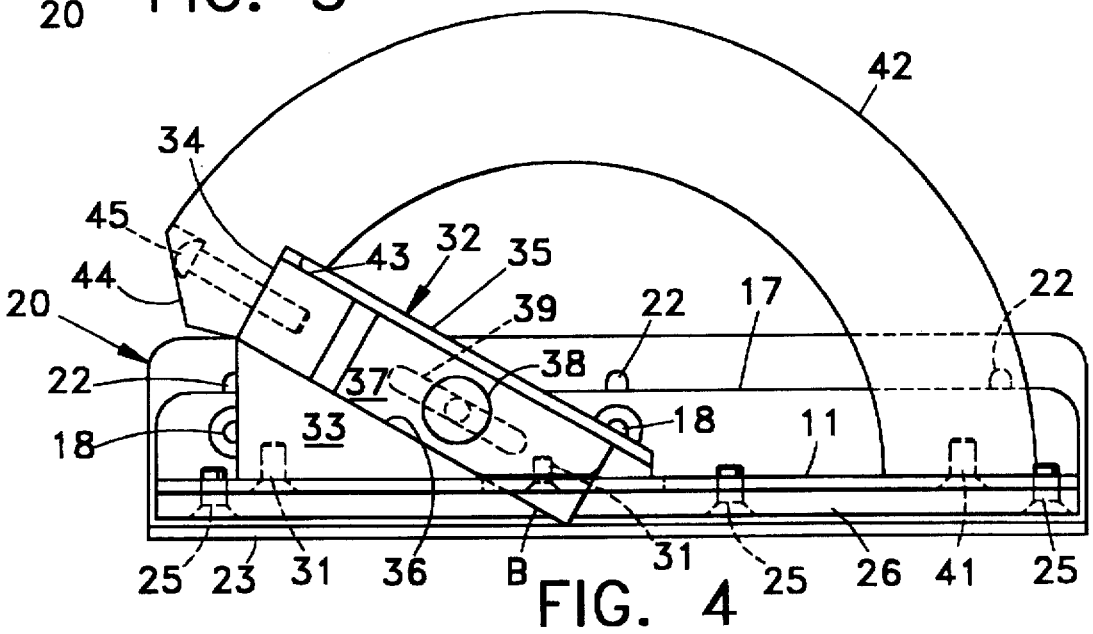
FIG. 4 is a side elevational view of this device as seen when looking toward the right side of the device as shown in FIG. 2.

Secured by a plurality of screws 25 to the underside of plate 11 is an elongate guide strip 26 of plastic, or the like, which is rectangular in cross section, and which has spaced, parallel side edges that extend parallel to slots 12–15 and the upturned edge 17 of plate 11. Secured by screws 31 to the upper surface of plate 11 immediately above and adjacent one end of the strip 26 is a blade and handle supporting block denoted generally by 32. Block 32 has a plane, rectangularly shaped bottom surface that is seated on plate 11, and spaced, parallel side walls 33. At one end thereof (the left end as shown in FIG. 4) block 32 has formed thereon a beveled surface 34 (FIGS. 2 and 4) which is inclined to the vertical, and which merges with the plane, flat upper surface 35, which is inclined downwardly from surface 34 to a point just above the upper surface of support plate 11. In each of its opposed side walls 33 block 32 has formed therein an elongate, shallow, rectangular notch or recess 36 which extends parallel to the inclined surface 35 of the block, and which opens at one end on the surface 34, and at its opposite end on one of the two slots 14 and 15 in plate 11. Adjustably secured in each of the recesses 36 and at opposite sides of block 32 is an elongate, generally rectangularly shaped cutting blade B. Each blade B is secured in its associated notch 36 by a rectangularly shaped blade cover 37, which is secured over the blade by the head of a screw 38 the shank of which extends through an elongate adjusting slot 39 in the associated blade, and threads releasably into the block 32.

Secured at one end thereof by a screw 41 (FIG. 4) to the upper surface of plate 11 substantially centrally of the underlying strip 26, and adjacent the rear edge of plate 11, is an elongate, arcuate hand grip or handle 42. The opposite end of handle 42 has formed in its inside surface a right angular notch 43, which engages over the upper end of the block 32 in such a manner that the end portion 44 of handle 42 overlies surface 34 and it is secured thereto by a screw 45. Plate 11 and its attachments, therefore, can be manipulated by handle 42.

Two additional blade supporting blocks 52 and 62 having thereon respectively, beveled surfaces 54 and 64, which are similar in configuration to, but approximately half the thickness of the block 32, are fastened at their undersides to the upper surface of plate 11 by screws 55 and 65, respectively. Blocks 52 and 62 are disposed in spaced, parallel relation to each other and to block 32 between the latter and the upstanding portion 17 of the base plate 11. These blocks have in one side only thereof, the right sides as shown in FIG. 2, diagonally extending notches or recesses 56 and 66, respectively, which are similar to the notches 36 employed in block 32. Although not illustrated in FIG. 2, it will be apparent that a blade B is secured in each of the notches 56 and 66 by an associated cover plate, which is similar in configuration to the cover plate 37, and which is secured over its associated blade by a headed nut 38, similar to the nuts 38 used in connection with block 32.

Thus, as shown for example in FIG. 2, the blades B in each of the blocks 32, 52 and 62 can be adjusted so that their cutting edges extend downwardly into operative positions beneath the underside of plate 11. If either of the two blades B that are mounted on block 32 are moved downwardly into their operative positions, their cutting edges will extend below the underside of the guide strip 26. In use, it is often desirable to use a straight edge member 70, which is denoted in phantom by broken lines in FIG. 2. In such circumstances the straight edge 70 is disposed to have one edge thereof slidably engaged with one side edge or the other of the guide 26. Also during use the supporting bracket 20 may have the lower leg section 23 thereof positioned on the floor or on a plane, flat surface, and beneath the edge of the carpet C, which is shown in phantom by broken lines in FIG. 2. In such case one portion of the carpet would overlie the section 23 of the bracket.

From the foregoing, it will be apparent that the present invention provides a relatively simple and inexpensive means for simultaneously cutting a plurality of elongate carpet strips from a piece of carpeting. The guide strip 26 on the underside of plate 11 can be used in conjunction with a straight edge so that the strips cut by the cutting device will be perfectly parallel to each other, particularly since the blocks 32, 52 and 62 fix their associated cutter blades in spaced, parallel relation to each other so that the edges of each respective carpet strip that is cut, will remain in equi-spaced, parallel relation to each other. In the event that the height of the associated pile on the carpet that is being cut is particularly high or low, the plate 11 can be adjusted vertically relative to the supporting bracket leg 23 via the conventional nut/bolt combinations 18, and the vertical slots in leg section 21 of the bracket. Also, of course, each blade B can be adjusted longitudinally in its associated block recess 36, 56 or 66 by proper manipulation of the associated screw 38, thereby to adjust the depth to which the blade projects beneath the underside of plate 11.

While this invention has been illustrated and described in detail in connection with only certain embodiments thereof, it will be apparent that it is capable of still further modification, and that this application is intended to cover any such modifications as may fall within the scope of one skilled in the art, or the appended claims.

We claim:

1. A tool for simultaneously cutting a plurality of strips of carpet from a section thereof, comprising a base plate having an upper surface and a lower surface, and having therethrough a plurality of spaced, parallel slots, a plurality of blade supporting blocks each having a lower end thereof secured to said upper surface of said plate, each of said blocks having therein at least one elongate blade accommodating recess opening at one end thereof upon and registering with one of said slots in said base plate, means for adjustably securing one of a plurality of cutting blades in each of said recesses with a sharp cutting end of each of said blades disposed to extend adjustably beyond said one end of its associated recess and through the registering slot in said base plate, a handle operatively secured at opposite ends thereof to said base plate and having intermediate its ends a hand grip portion thereof overlying said upper surface of said base plate and extending parallel to said slots, and an elongate guide strip secured to said lower surface of said base plate and having at least one longitudinal side edge thereof extending parallel to said slots.

2. A tool as defined in claim 1, wherein one of said blocks has therein a plurality of said blades accommodating recesses in each of which is secured one of said cutting blades.

3. A tool as defined in claim 1, wherein each of said blocks has said at least one blade accommodating recess thereof formed in one side of the associated block to extend diagonally and transversely of said base plate between an upper end of the block and said lower end thereof, and said means for adjustably securing one of said blades in each of said recesses includes manually operable means for effecting longitudinal adjustment of the associated blade in its associated recess, and operable to permit insertion of a blade into, or withdrawal of a blade from said associated recess.

4. A tool as defined in claim 3, wherein at least one of said blocks has two opposed side surfaces in each of which is formed one of said blade accommodating recesses.

5. A tool as defined in claim 4, wherein at least one other of said blocks has a blade accommodating recess formed in only one side thereof.

6. A tool as defined in claim 3, wherein said guide strip is secured to the lower surface of said base plate approximately centrally of opposed side edges of said plate, one of said blocks is secured on said base plate to register approximately with one end of said guide strip, and has on the upper end thereof a beveled surface inclined transversely to said base plate, and said handle is secured at one end thereof against said beveled surface on said one block, and at its opposite end on said upper surface of said base plate.

7. A tool as defined in claim 1, including a support member having thereon a plane surface disposed to be positioned beneath and parallel to the lower surface of said base plate, and means adjustably supporting said base plate on said support member with said lower surface of said base plate disposed in spaced relation above and parallel to said plane surface on said support member.

8. A tool as defined in claim 7, wherein said base plate has a marginal flange portion adjacent one side thereof extending transversely of said upper and lower surfaces thereof, said support member has thereon a marginal flange portion extending transversely of said plane surface thereon, and in overlapping relation to the marginal flange portion of said base plate, and said means adjustably supporting said base plate on said support member comprises means adjustably securing said overlapping flange portions together, and operable manually to adjust the height of said lower surface of said base plate with respect to said plane surface on said support member.

9. A tool as defined in claim 8, wherein one of said flange portions has therein a plurality of spaced, parallel slots extending normal to said plane surface on said support member, and said means adjustably securing said flange portions together comprises a plurality of bolts each having a shank portion extending through its associated slot in said one flange portion and a registering circular opening in the other of said overlapping flange portions.

10. A tool as defined in claim 1, including a flange formed along one edge of said base plate to extend parallel to said slots and normal to the upper and lower surfaces of said plate, a right-angular support plate having two sections thereof intersecting at right angles, one of said sections extending beneath and parallel to the lower surface of said base plate, and at least a portion of the other section thereof extending into overlapping relation with at least a portion of said flange, and means adjustably securing together said overlapping portion of said flange and said one section of said support plate, thereby adjustably to maintain said lower surface of said base plate in spaced, parallel relation to said one section of said support plate.

11. A tool as defined in claim 1, wherein each of said blocks has formed on at least one side thereof a plane surface extending transversely of said base plate and registering with one of said slots, and each of said blade accommodating recesses is formed in said plane surface at said one side of a respective block to extend diagonally of said base plate.

12. A tool as defined in claim 11, wherein each of said blocks is generally rectangularly shaped in cross section and has spaced, parallel side walls, and at least one side wall of each of said blocks has formed therein one of said blade accommodating recesses which extends diagonally of said base plate.

13. A tool as defined in claim 12, wherein at least one of said blocks has one of said blade accommodating recesses formed in each of the two side walls thereof, each of the last-named recesses opening at its lower end on one of a pair of adjacent slots in said base plate.

* * * * *